US007837048B2

(12) United States Patent
Lusker

(10) Patent No.: US 7,837,048 B2
(45) Date of Patent: Nov. 23, 2010

(54) MULTI-COLORED CONTAINER

(76) Inventor: Ronald Lusker, 85 Mercer St., New York, NY (US) 10012

( * ) Notice: Subject to any disclaimer, the term of this patent is extended or adjusted under 35 U.S.C. 154(b) by 1262 days.

(21) Appl. No.: 11/349,291

(22) Filed: Feb. 6, 2006

(65) Prior Publication Data

US 2007/0183140 A1 Aug. 9, 2007

(51) Int. Cl.
*B65D 1/02* (2006.01)

(52) U.S. Cl. ..... 215/379; 220/662

(58) Field of Classification Search ..... 215/12.2, 215/379; 446/219; 220/662; 40/453; 428/542.2
See application file for complete search history.

(56) References Cited

U.S. PATENT DOCUMENTS 3,343,568 A * 9/1967 Branscum et al. ..... 138/178
3,501,256 A * 3/1970 Milliken ..... 431/291
3,647,279 A * 3/1972 Sharpless et al. ..... 349/23
3,659,705 A * 5/1972 Falkin ..... 206/784
3,702,806 A * 11/1972 Oliva ..... 435/304.1
4,165,812 A * 8/1979 Jennison ..... 215/10
4,280,632 A * 7/1981 Yuhara ..... 215/331
D284,839 S * 7/1986 Biesecker ..... D9/572
5,008,143 A * 4/1991 Armanini ..... 428/207
5,566,846 A * 10/1996 James ..... 215/230
D385,800 S * 11/1997 Lusker ..... D9/571
6,077,579 A * 6/2000 De Laforcade ..... 428/35.7
D496,286 S * 9/2004 Krunas ..... D9/572
2003/0211259 A1 * 11/2003 Lam et al. ..... 428/35.7

FOREIGN PATENT DOCUMENTS

WO WO 99/55629 * 11/1999

* cited by examiner

*Primary Examiner*—Sue A Weaver
(74) *Attorney, Agent, or Firm*—Locke Lord Bissell & Liddell LLP

(57) ABSTRACT

A multi-colored transparent or semi-transparent container having at least two discrete sidewall regions, each discrete region having a different transparent color such that when the container is viewed it exhibits multiple transparent colors or gradations of color. The container may have a generally polygonal or round cross section. The container may further include a transparent, semi-transparent or transparent colored inscription or image, as well as a light source for illuminating the inscription or image.

9 Claims, 10 Drawing Sheets

MULTI-COLORED CONTAINER

FIELD OF THE INVENTION

The present invention relates to a container for holding products. More particularly, the invention relates to a transparent or semi-transparent container that has a multi-colored appearance.

BACKGROUND OF THE INVENTION

Transparent and semi-transparent containers have been commonly used in the consumer product industry to allow ready inspection of the quality of the contents of the containers. Typically, transparent or semi-transparent containers are colorless or clear to enhance the ability to inspect the contents of the container. Sometimes it is desirous to use a transparent or semi-transparent colored container to inhibit UV light degradation of or to alter the appearance of the contents of the container.

SUMMARY OF THE INVENTION

In accordance with the present invention, a multi-colored transparent or semi-transparent container is provided by applying different transparent colors to separate portions of the container. The container may have a substantially round or polygonal horizontal cross-section. In one embodiment, the container has a substantially triangular horizontal cross-section comprising a first side, a second side, and a third side and a top and an enclosed bottom. The sides of the container may be dimensioned to form an isosceles triangle in horizontal cross-section. At least one side of the container has a transparent color. Each of the other sides of the container may have a different transparent color, the same transparent color or be colorless.

The container may be formed from hard or soft plastic, glass or any other transparent or semi-transparent material. The container may have any configuration wherein the side walls are substantially flat. The closed end of the container may be flat, rounded, tapered or concave. The open end of the container may have a flat, rounded or concave shoulder and an opening through which the contents of the container may be dispensed. The container may also have a neck that extends from the shoulder and forms the opening of the container. The opening may also be formed to receive a detachable stopper or threaded cap. The stopper or cap may be positioned on the top of the container such that the container stands on its closed end. Alternatively, the stopper or cap may be positioned on the bottom of the container such that the container stands on the stopper or cap.

In one embodiment of the invention, the container has multiple sides comprising relatively flat panels with at least one of the sides has a transparent color. The containers may contain a substantially transparent product such as a clear fluid whereby a viewer may look through the container and view a first side of the container, the contents of the container, and a second side of the container. The first side of the container, the contents of the container, and the second side of the container can each have a different transparent color. By looking through a side of the container, a viewer may view a color that results from the combined effects of the transparent colors of the first side of the container, the contents of the container, and the second side of the container.

In another embodiment of the invention, the container has a generally round cross-sectional with discrete portions of the container sidewall having different transparent colors. Other discrete portions of the container sidewall may be colorless The product contained in the container may have a transparent color or be substantially colorless. The container exhibits a multi-colored appearance as a result of the combined effects of the transparent colored or colorless discrete portions of the container sidewall and the transparent colored or colorless contents of the container.

The container may exhibit multiple different colors or gradations of colors along different sight lines on the container sidewall. For example, in a container having either a polygonal horizontal cross-section or a round horizontal cross-section, the distance from one side of the container to the other side of the container varies. Due to this variation in distance, the contents of the container may have different gradations of color when viewed through a side of the container. Accordingly, the container may exhibit different colors or gradations of colors of the different color contributed by the contents at any given location. Furthermore, if the container is only partially filled with contents, the portion of the container without any contents may exhibit different colors or gradations of colors than the portion of the container having contents. For example, if the container is half empty, the top half of the container having no contents may exhibit a different color than the bottom half of the container.

In accordance with an aspect of the present invention, the different transparent colors of the sides or discrete portions of the container may be provided by applying a colored transparent film, ink or coating to the sides of the container. Alternatively, colorants or dyes may be added to the transparent of semi-transparent material when the container is manufactured such as by injection molding or blow molding.

In accordance with another aspect of the present invention, complimentary transparent colors may be applied to different sides or discrete portions of the container to produce a container having an opaque appearance. For example, one side of the container may be applied with a transparent red color and another side of the container may be applied with a transparent green color. When viewed through the green and red transparent colored sides, the container will appear opaque.

In accordance with another aspect of the present invention, one or more sides of the container may have an inscription in the form of an image, logo, text, dot code or bar code. The inscription may be colorless or a different color than the transparent color of the side of the container on which it is inscribed. For example, one side of the container may be a transparent red color and another side of the container may be a transparent green color having a clear or colorless inscription. When the container is viewed through the green and red transparent complimentary colored sides, the inscription will appear on the otherwise opaque backdrop of the container.

In accordance with another aspect of the present invention, a white or colored light emitting diode may be used to illuminate images, insignia, dot codes or bar codes inscribed in one of the sides of the container. The light emitting diode may be integral with the container or may be associated with a remote device that focuses a beam of light on the container. For example, the container may have two sides with complimentary transparent colors which combine to create an opaque appearance when viewed together. One of the sides of the container may be inscribed with an image, insignia or code. The container may further include a light emitting diode mounted in the cap that encloses the opening at the top of the container. The light emitting diode may be positioned to direct light from the interior of the container through the side of the container having the inscription such that the inscription is illuminated when viewed against the otherwise opaque backdrop of the container created by the complimentary transparent colors of the container side walls.

In accordance with the present invention, the multi-colored appearance of the container is achieved by using different transparent colors under the subtractive color model. Light consists of a spectrum of energy waves have a wide range of wavelengths. The human eye can only detect a small portion of the energy wave spectrum. This is called the visible light spectrum. At one end of the visible light spectrum are short wavelengths of light that the human eye perceives as blue. The other end of the visible light spectrum are longer wavelengths of light that the human eye perceives as red. All other colors visible to the human eye are found somewhere along the spectrum between blue and red. If the visible light spectrum is divided into thirds, the predominant colors or primary colors are red, green and blue, with green being in the middle of the visible light spectrum. The subtractive color system uses colorants to subtract portions of the white light illuminating an object to produce other colors of the visible spectrum. Under the subtractive color system, an object having a colorant absorbs or subtracts portions of the visible light illuminating the object and reflects the portion of the visible light that is not absorbed. If an object reflects all of the white light back to the viewer, the object appears white. Conversely, if an object adsorbs all of the white light, the object appears opaque.

In the subtractive color system, the primary colors are cyan, magenta and yellow. Under the subtractive color system, a colorant that absorbs one color wavelength reflects the combined color of the light associated with the unabsorbed wavelengths. A colorant is thus the complement of the color it adsorbs or subtracts from white light. For example, the colorant that absorbs the wavelength associated with red light is cyan, because it reflects and combines blue and green light. Similarly, magenta is the colorant that absorbs the wavelength associated with green light, because it reflects and combines red and blue light. Yellow is the colorant that absorbs the wavelength associated with blue light, because it reflects and combines red and green light. Thus, cyan is the complement of red, magenta is the complement of green, and yellow is the complement of blue.

The subtractive color model combines cyan, magenta, and yellow in various amounts to create all of the colors of the visible spectrum. For example, combining cyan and magenta in equal amounts yields blue, combining magenta and yellow in equal amounts yields red, and combining yellow and cyan in equal amounts yields green.

BRIEF DESCRIPTION OF THE DRAWINGS

The foregoing and other objects and advantages of the present invention will be appreciated more fully from the following detailed description with references to the accompanying drawings wherein.

DETAILED DESCRIPTION OF THE INVENTION

The present invention relates to a transparent or semi-transparent container having a generally round or geometric, polygonal horizontal cross-section wherein at least discrete portion or one side of the container has a transparent or semi-transparent color. The transparent or semi-transparent colors and shape of the container allows a viewer to view combinations and gradations of color by looking through any side or portion of the container. One or more sides of the container may also be inscribed with an image, logo, text, bar code and/or dot code that ,when viewed, has a different color than the color of the container.

Figure 1:
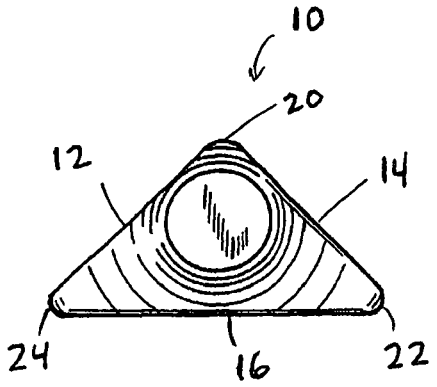
FIG. 1 is a first embodiment of a container of the present invention having a generally isosceles triangle horizontal cross-section.

Referring to FIGS. 1 through 4, an embodiment of a container 10 in accordance with the present invention is illustrated. As illustrated in FIG. 1, container 10 is substantially isosceles in configuration and has a first and second sides 12, 14 that are substantially equal in length and a third side 16 forming a hypotenuse. The first and second sides 12, 14 meet at a rounded corner 20, the second side 14 meets the third side 16 at a rounded corner 22 and the first side 12 meets the third side 16 at a rounded corner 24.

Container 10 can be formed of transparent plastic or glass so that the contents are readily visible to a consumer. The use of a transparent medium is advantageous when consumers want to inspect the container contents. Furthermore, a transparent medium exhibiting color may be visually pleasing to a consumer.

Food grade containers use colorants to inhibit ultra violet light. According to an embodiment of the present invention having an isosceles triangular shaped horizontal cross section, the two equal length sides may be red and green, respectively, and the hypotenuse may be clear or transparent. Disposing two such containers side-by-side to form a square such that the hypotenuse sides are adjacent each other creates a multi-colored display having red and green sides which inhibit ultra violet light from degrading the contents of the containers.

If container 10 is glass it may be made of, for example, borosilicate glass or a lime sodium glass. If container 10 is plastic it may be made of, for example, a thermoplastic polyester such as polyethylene terephthalate (PET) or a polyproplyene.

It will be understood that the transparent colorants may be applied to the container side walls in any suitable manner known in the art. For example, the transparent colorants may be incorporated by applying a colored film or coating to the sides of the container. The colored film or coating may be applied by fitting a transparent colored sleeve around the sides of the container. The sleeve may be shrink wrapped to the bottle. Alternatively, the colorant may be applied using dyes added to the transparent or semi-transparent material when the container is manufactured such as by injection molding or blow molding. Similarly, the colorants may be applied by printing or staining the side walls of the container.

A blank or mold used for injection or blow molding may be made in a conventional manner such as by extrusion or injection molding. A mold for the manufacture of a glass container may be made of a metal such as cast iron. A blank for the manufacture of a plastic container may be made of a material such as a polyvinyl, polyethylene or a polyproplyene.

The mold is of a shape complementary to a shape of the container. However, the shape of the mold is only given by way of example. There exist other types of molds consistent with the present invention, for example, molds formed by multiple sections that are capable of being joined together. These molds formed by multiple sections, for example, may have a separate area for each side of the container. These sectional molds may easily enable each side of the container to be made of a transparent colored material exhibiting a different color.

Figure 2:
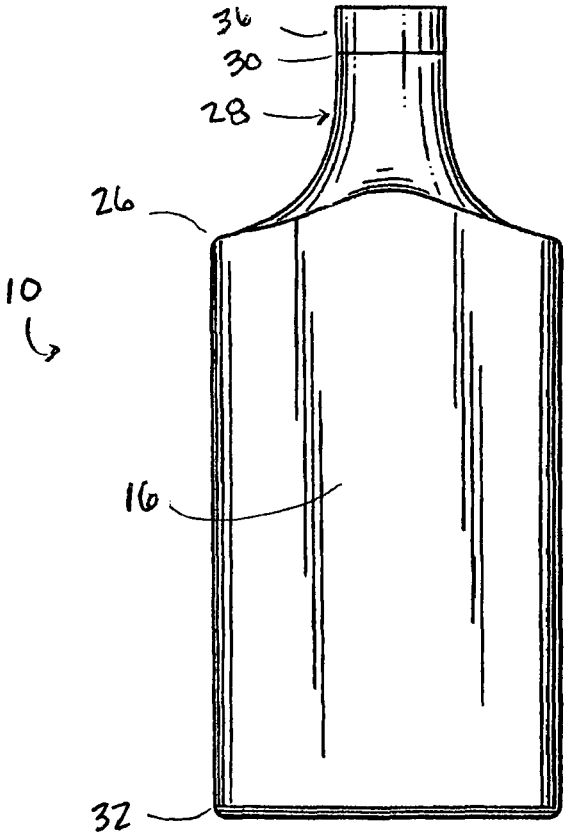
FIG. 2 is a rear elevation view of the container of FIG. 1.
Figure 4:
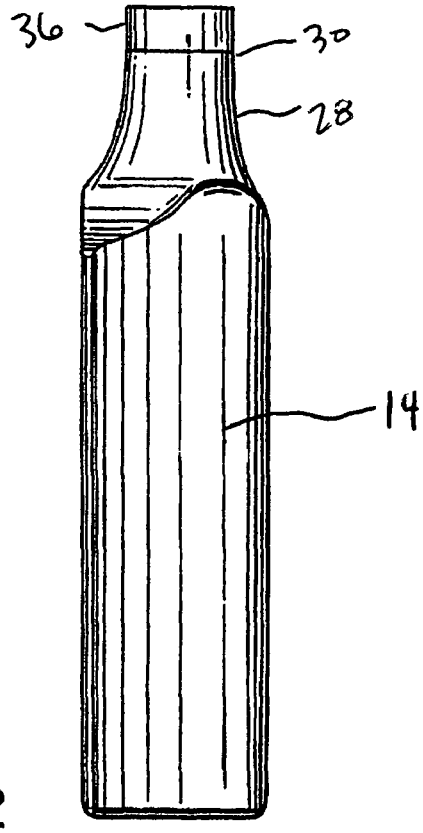
FIG. 4 is a side elevation view of the container of FIG. 1.
Figure 3:
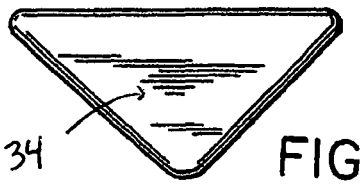
FIG. 3 is a bottom plan view of the container of FIG. 1.

Referring to FIG. 2, the container 10 has a shoulder 26 at the top of each of the sides. The shoulder 26 narrows to form a neck 28 that receives a detachable cap 36 at the top of the container 30. The detachable cap 36 engages the top of the container 30 in a liquid tight manner. The container also has a rounded base 32 at the lower end of the container. The bottom of the container has a surface 34 that is substantially flat.

Figure 5:
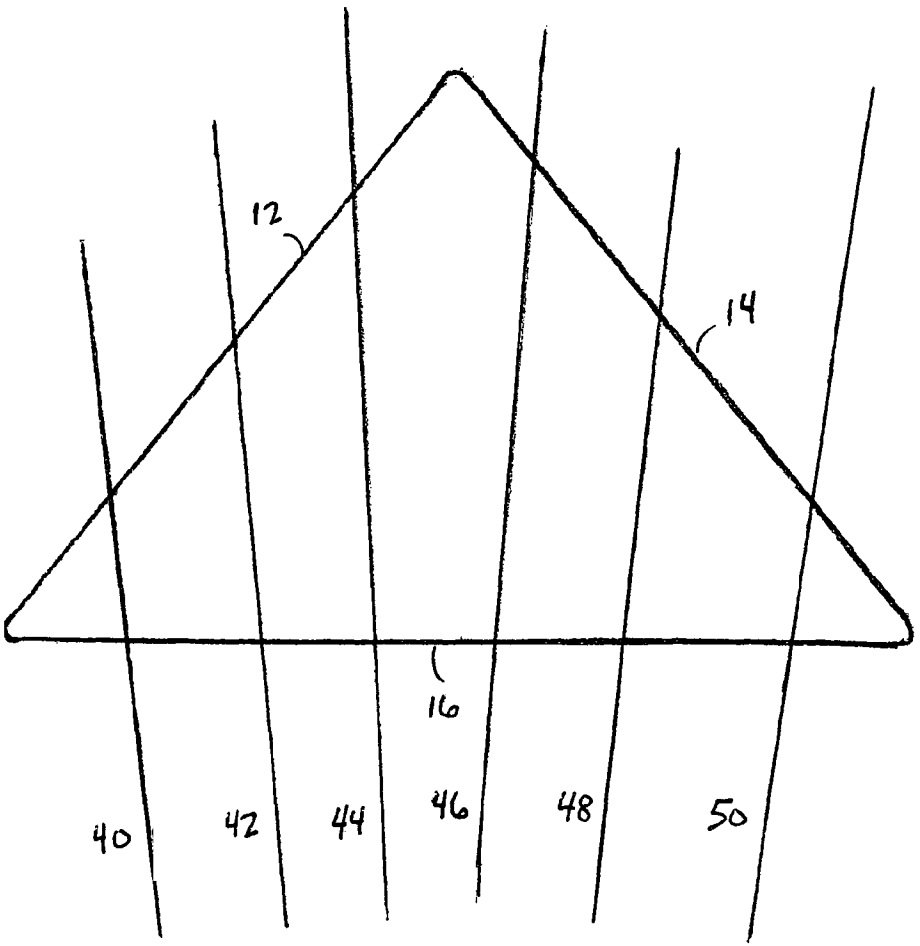
FIG. 5 is a cross-sectional top plan view of the container of FIG. 1.

FIG. 5 shows a horizontal cross-sectional view of the container of FIG. 1 with sight lines 40, 42, 44, 46, 48 and 50. In this embodiment, container 10 is made of a transparent medium and the first side 12 exhibits a first transparent color, second side 14 exhibits a second transparent color, and third side 16 exhibits a third transparent color. The first, second and third transparent colors are combinations of various amounts of colorants of cyan, magenta and yellow in accordance with the subtractive color model. By way of example and not by way of limitation, first side 12 may exhibit a transparent blue color by combining equal amounts of cyan and magenta colorants, second side 14 may exhibit a transparent yellow color by using a yellow colorant, and third side 16 may exhibit a transparent red color by combining equal amounts of magenta and yellow colorants.

In this embodiment, a viewer may look through third side 16 along sight lines 40, 42, 44, 46, 48, and 50. If container 10 is empty or is filled with a colorless transparent liquid, the viewer may view the color exhibited by third side 16 and the color exhibited by first side 12 in combination by looking along sight lines 40, 42, and 44. In the above example, if the first side 12 exhibits transparent blue and the third side 16 exhibits transparent red, the viewer may view a violet color by looking along sight lines 40, 42, and 44. If the second side 14 exhibits transparent yellow and the third side 16 exhibits transparent red, the viewer may view an orange color by looking along sight lines 46, 48, and 50. Thus, a viewer may look through a single side of container 10 and view different colors.

In another embodiment, container 10 is filled with a transparent liquid exhibiting a color. For example, container 10 may be filled with white wine. In this embodiment, the viewer may view the color exhibited by third side 16, the color of the transparent liquid in the container, and the color exhibited by first side 12 in combination along sight lines 40, 42, and 44. The amount of the color of the transparent liquid that is combined with the colors exhibited by first side 12 and third side 16 is different along each of sight lines 40, 42, and 44 because the distance between the first side 12 and third side 16 along sight line 40 is shorter that the distance between first side 12 and third side 16 along sight line 42, which is shorter than the distance between first side 12 and third side 16 along sight line 44. Accordingly, a viewer may view different gradations of color by looking along each of sight lines 40, 42, and 44 because the different amounts of transparent liquid exhibit different shades of colors. These different shades of colors are combined with the colors exhibited by the first side 12 and third side 16 of the container. Similarly, the amount of the color of the transparent liquid that is combined with the colors exhibited by second side 14 and third side 16 is different along each of sight lines 46, 48, and 50 because the distance between second side 14 and third side 16 along sight line 46 is greater that the distance between second side 14 and third side 16 along sight line 48, which is greater than the distance between second side 14 and third side 16 along sight line 50. Therefore, a viewer may view different gradations of color by looking along each of sight lines 46, 48, and 50 because the different amounts of transparent liquid exhibit different shades of colors. These different shades of colors are combined with the colors exhibited by second side 14 and third side 16 of the container.

Figure 6:
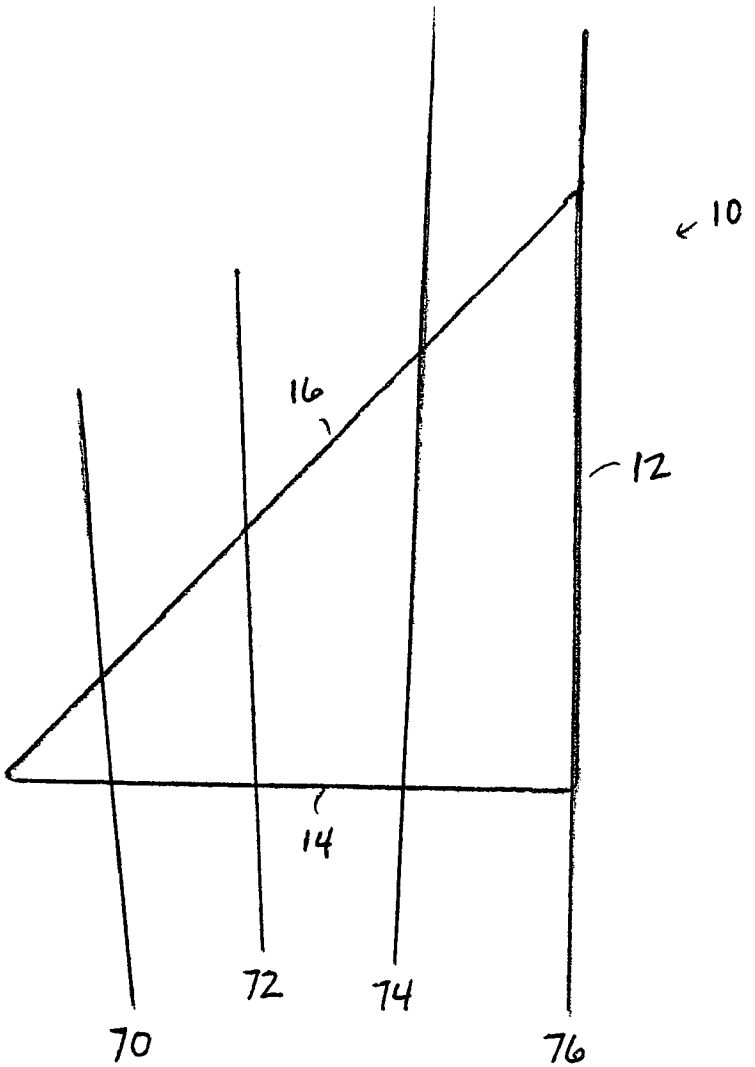
FIG. 6 is a cross-sectional top plan view of the container of FIG. 1 from a different orientation.

FIG. 6 shows a horizontal cross-section view of the container of FIG. 1 with sight lines 70, 72, 74 and 76. In this embodiment, a viewer may look through second side 16 along sight lines 70, 72, 74, and 76. If container 10 is empty or is filled with a colorless liquid, a viewer may view the color exhibited by second side 14 and the color exhibited by third side 16 in combination by looking along sight lines 70, 72, and 74. A viewer may view the color exhibited by first side 12 by looking along sight line 76. If container 10 is filled with a transparent liquid exhibiting a color, a viewer may view the color exhibited by third side 16, the color of the transparent liquid in the container, and the color exhibited by second side 14 in combination along sight lines 70, 72, and 74. The amount of the color of the transparent liquid that is combined with the colors exhibited by second side 14 and third side 16 is different along each of sight lines 70, 72, and 74 because the distance between second side 14 and third side 16 along sight line 70 is shorter that the distance between second side 14 and third side 16 along sight line 72, which is shorter than the distance between second side 14 and third side 16 along sight line 74. Accordingly, a viewer may view different gradations of color by looking along each of sight lines 70, 72, and 74 because the different amounts of transparent liquid exhibit different shades of colors. These different shades of colors are combined with the colors exhibited by second side 14 and third side 16 of the container.

Figure 7:
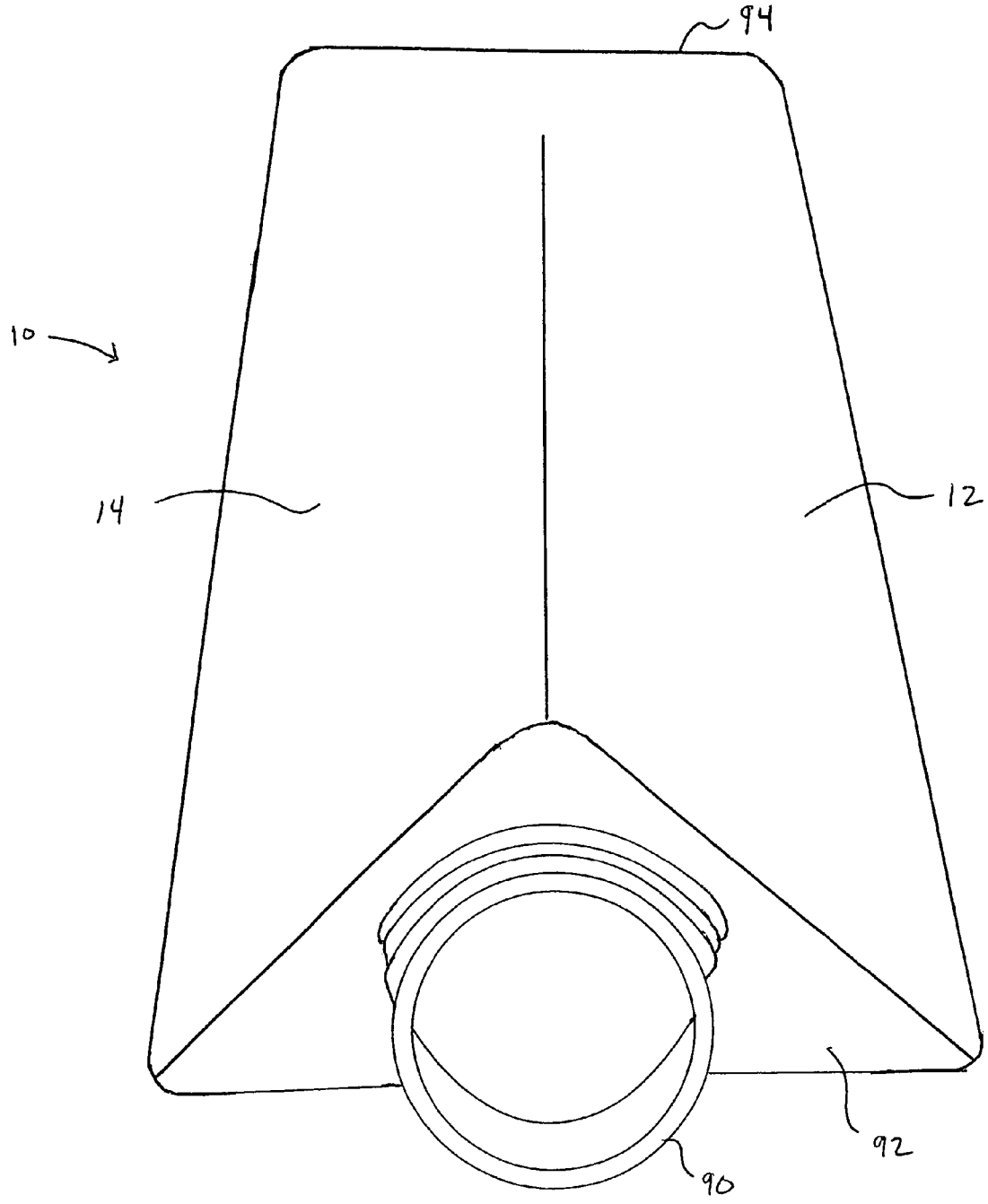
FIG. 7 is a perspective view of a second embodiment of a container of the present invention having a generally isosceles triangle horizontal cross-section.
Figure 8:
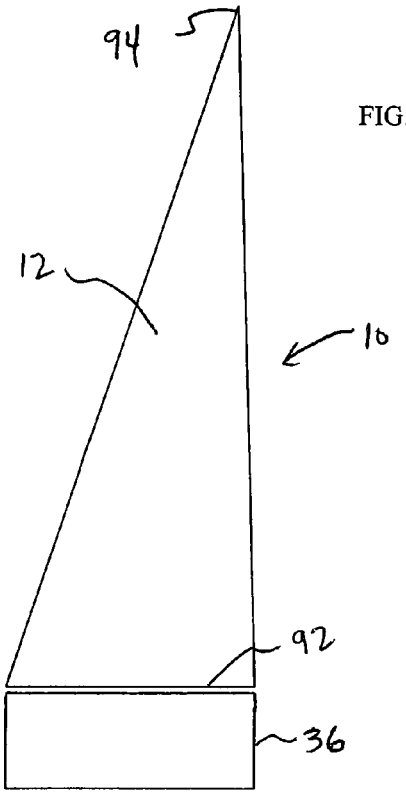
FIG. 8 is a side elevation view of the container of FIG. 7.
Figure 9:
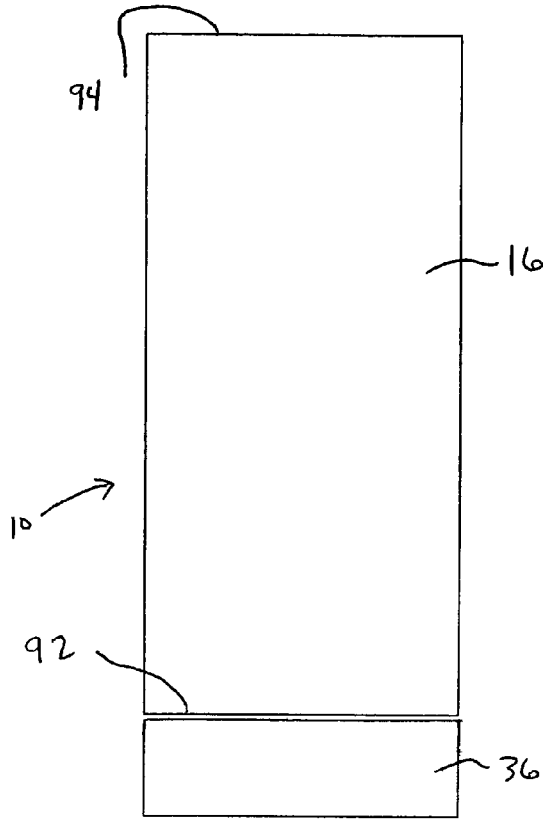
FIG. 9 is a front elevation view of the container of FIG. 7
Figure 10:
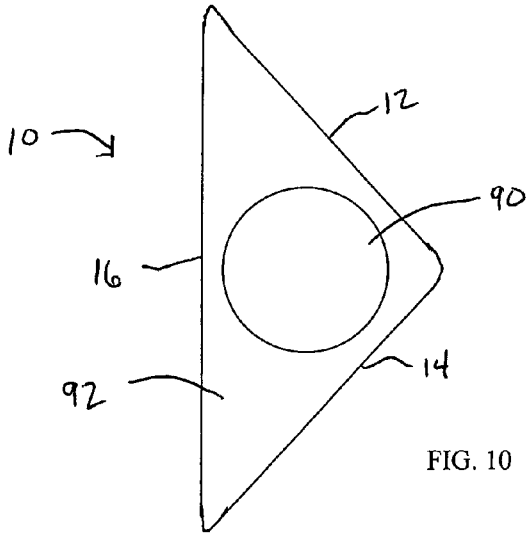
FIG. 10 is a top plan view of the container of FIG. 7.

The present invention may also be adapted for use with the container illustrated in FIGS. 7-10. As shown in FIG. 7, container 10 has a substantially isosceles triangle cross-section. As further shown in FIGS. 7-9, each of the side walls 12 and 14 is tapered along its length such that the cross-sectional area of the container gradually decreases from shoulder 92 to bottom end 94. Shoulder 92 has an opening 90 which may be fitted to threadably receive a cap 36. Alternatively, the opening 90 may be fitted to detachably receive a non-threaded plug cap or any other suitable type of cap or stopper.

As with the embodiment described above with reference to FIGS. 1-6, container 10 shown in FIGS. 7-10 can be formed of any transparent or semi-transparent material such as plastic or glass. For example, container 10 may be formed of a soft pliable transparent or semi-transparent plastic material to permit the contents of the container to be discharged by squeezing the sides of the container. Container may be formed by any conventional manner such as by extrusion or injection molding.

In accordance with the present invention, sides 12, 14 and 16 may have a transparent color or may be colorless or clear such that when a viewer looks through one of the sides the color exhibits by the container will be the combination of the colors contributed by the all of the sides and the contents of the container in the viewer's sight lines. It will be understood that due to the tapered lengths of the side walls 12 and 14 and the gradually decreasing cross-sectional area of the container, different gradations of colors may be exhibited along the length of the container.

Figure 11:
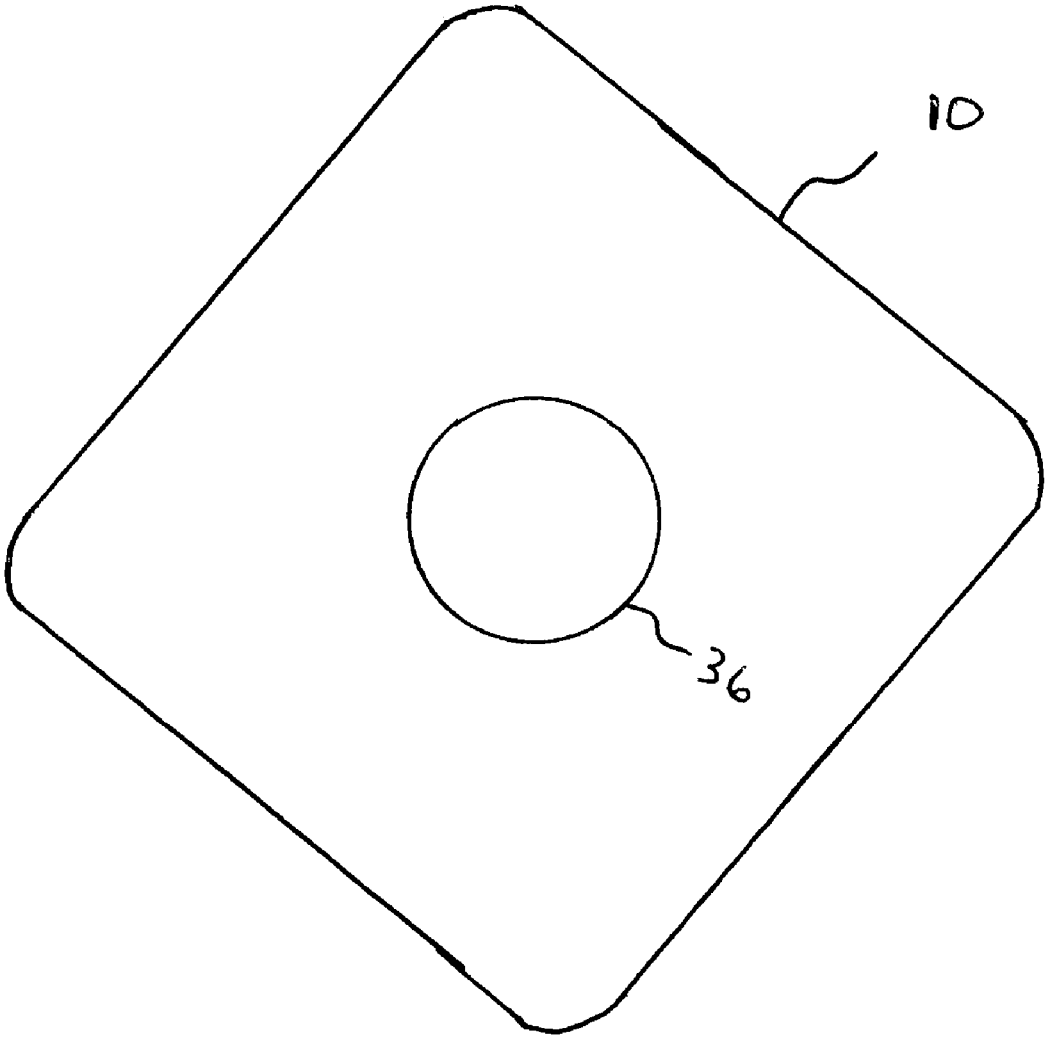
FIG. 11 is another embodiment of a container of the present invention having a generally square horizontal cross-section.
Figure 12:
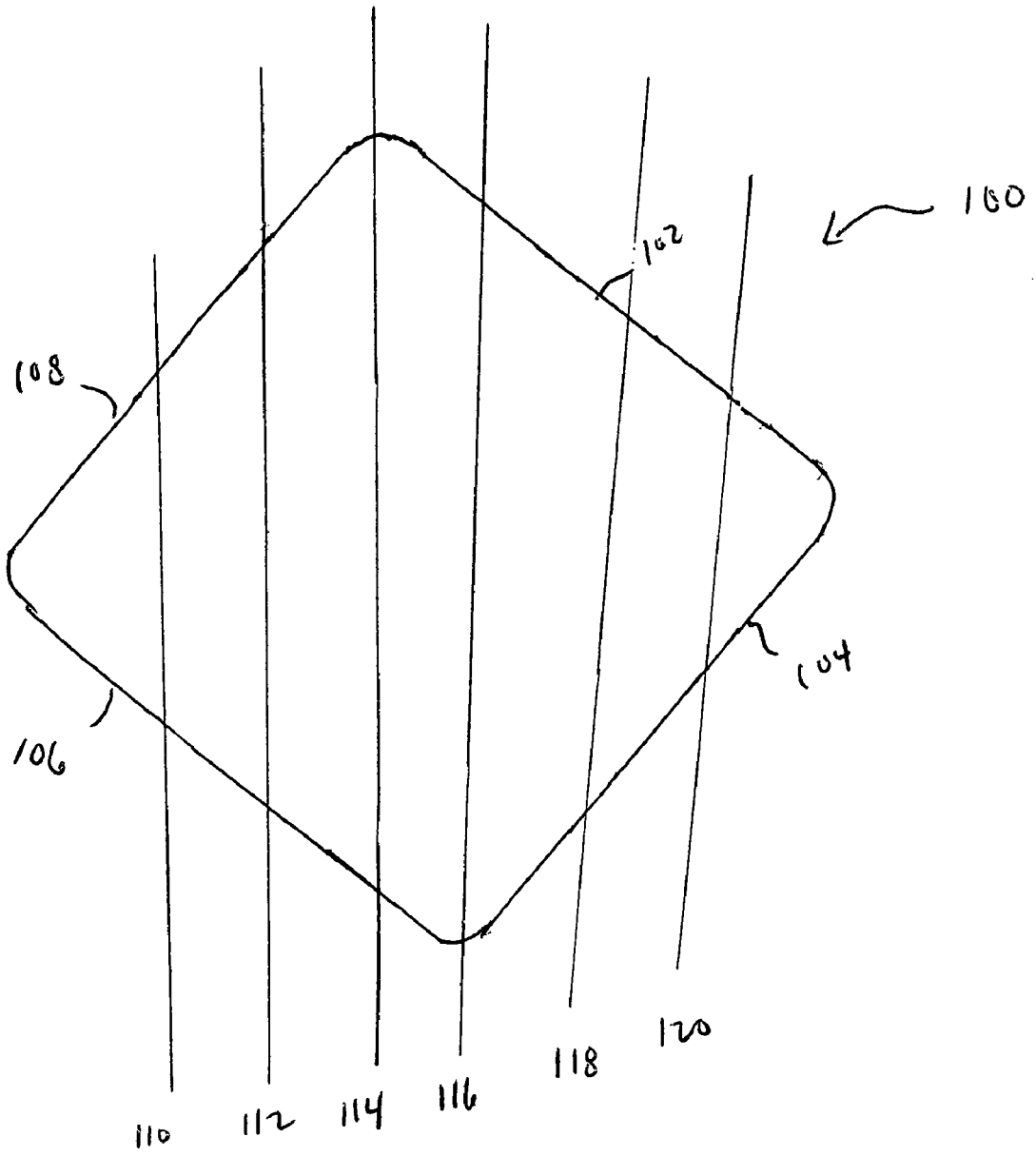
FIG. 12 is a cross-sectional top plan view of the container of FIG. 11.
Figure 13:
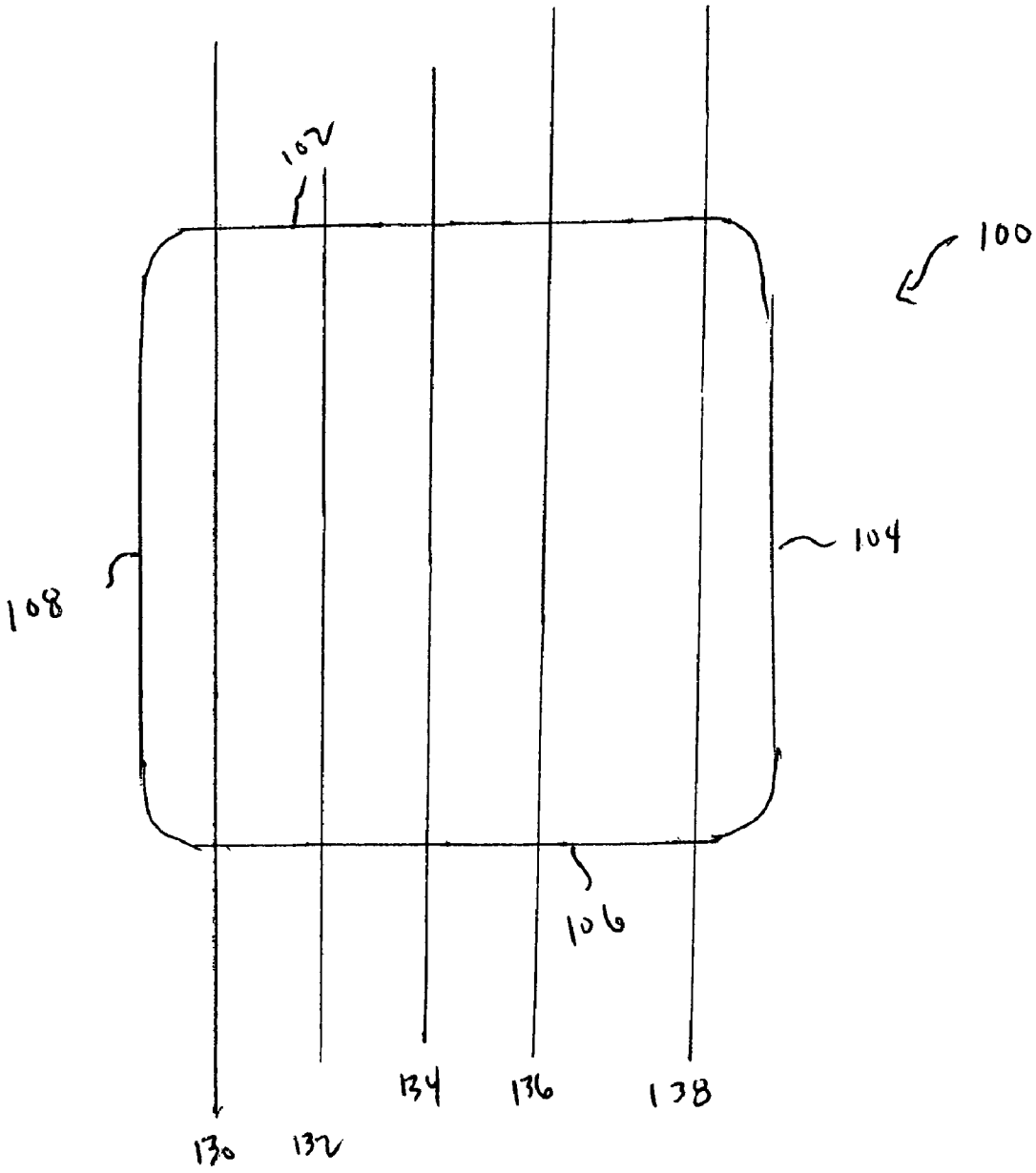
FIG. 13 is a cross-sectional top plan view of the container of FIG. 11 from a different orientation.

As demonstrated in FIGS. 11-13, the present invention may comprise any container having a polygonal horizontal cross-section. In the embodiment shown in FIGS. 11-13, the container has a generally square horizontal cross-section. It will be understood, the container may have any of a myriad of other polygonal horizontal cross-sections, such as a hexagon, heptagon, octagon, etc.

FIG. 12 shows a horizontal cross-sectional view of the container of FIG. 11 with sight lines 110, 112, 114, 116, 118, 120. Container 100 is formed of a transparent material and at least two of sidewalls 102, 104, 106 and 108 exhibit different transparent colors. A viewer looking through side 104 along sight line 118 will see a color resulting from the combination of the transparent colors of side wall 104 and side wall 102. Similarly, a viewer looking through side wall 106 along sight line 112 will see a color resulting from the combination of the transparent colors of side wall 106 and 108.

FIG. 13 shows a horizontal cross-section view of the container of FIG. 11 with sight lines 130, 132, 134, 136 and 138. A view looking through side 106 along any of these sight lines will see essentially the same color resulting from the combination of the transparent colors of side walls 106 and 102. If the transparent colors of side walls 106 and 102 are complimentary colors, the container will appear opaque to a viewer looking along sight lines 130, 132, 134, 136 and 138. For example side wall 106 maybe colored red and side wall 102 may be colored green.

The use of complimentary colors in this manner, may be further amenable to inscribing portions of one of the side walls with uncolored images. With reference to FIG. 13, side wall 106 may be inscribed with an uncolored image in the form of a word or bar code. When viewed along sight lines 130, 132, 134, 136 and 138, the container will appear black along all portions of side wall 106 that is colored. However, the uncolored images will appear green. It will be understood that the inscription may be formed in a colored film, coating applied to a surface of the container. It will further be understood that the colored film or coating having the inscription or cut-out may be applied to a container having colorants or dyes in the transparent material forming the walls of the container. For example, a transparent green film or coating having a clear inscription may be applied to a container formed of a transparent material having a red colorant or dye. In this embodiment, the inscription will appear red while the noninscribed portion of the container will appear opaque.

Figure 14:
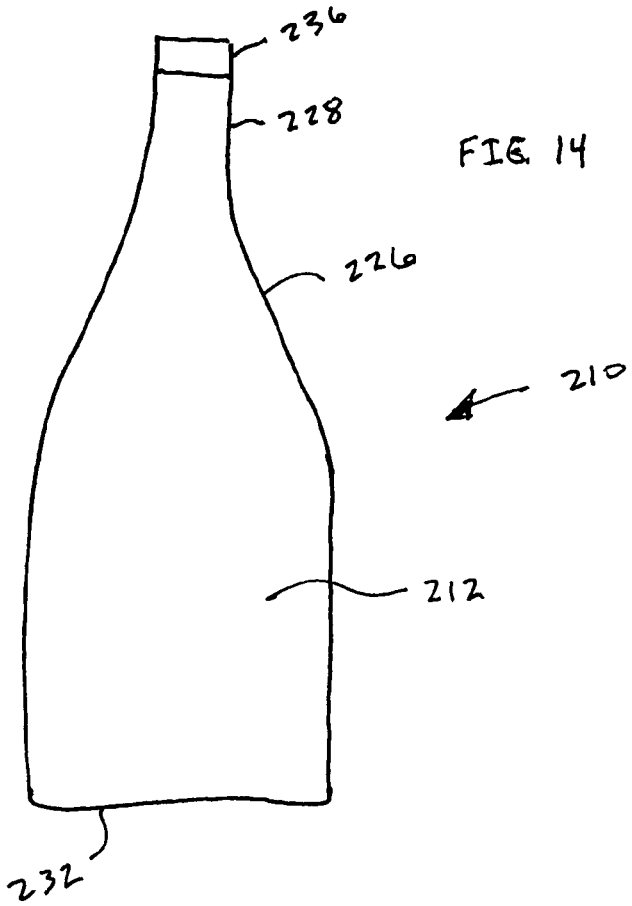
FIG. 14 is another embodiment of a container of the present invention having a generally round horizontal cross-section.
Figure 15:
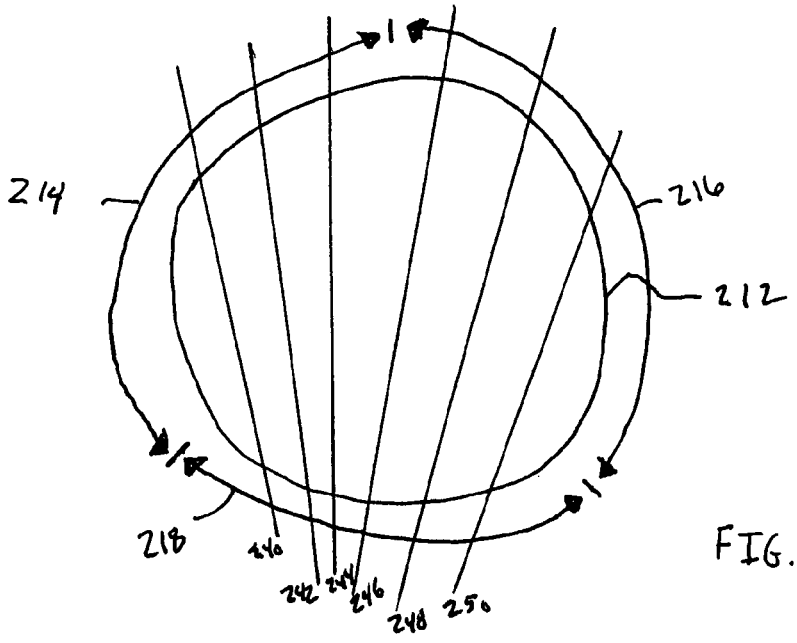
FIG. 15 is a cross-sectional top plan view of the container cap of FIG. 14.

The present invention may also be adapted for use with the container illustrated in FIGS. 14 and 15. As shown in FIG. 14, container 210 has a substantially round horizontal cross-section. As further shown in FIG. 14, the container comprises a base 232 having a substantially flat surface and a sidewall 212. The top of the container includes a shoulder 226 which leads to a neck 228 that defines an opening 230 for filling and dispensing the container contents. The neck 228 may be fitted to threadably receive a cap 236. Alternatively, the opening 230 may be fitted to detachably receive a non-threaded plug cap or any other suitable type of cap or stopper.

FIG. 15 shows a horizontal cross-sectional view of the container of FIG. 14 with sight lines 240, 242, 244, 246, 248 and 250. In this embodiment, container 210 is made of a transparent medium and a first discrete region 214 of sidewall 212 exhibits a first transparent color, a second discrete region 216 of sidewall 212 exhibits a second transparent color, and a third discrete region 218 of sidewall 212 exhibits a third transparent color. The first, second and third transparent colors are combinations of various amounts of colorants of cyan, magenta and yellow in accordance with the subtractive color model. By way of example and not by way of limitation, first discrete region 214 may exhibit a transparent blue color by combining equal amounts of cyan and magenta colorants, second discrete region 216 may exhibit a transparent yellow color by using a yellow colorant, and third discrete region 218 may exhibit a transparent red color by combining equal amounts of magenta and yellow colorants.

In this embodiment, a viewer may look through third discrete region 218 along sight lines 240, 242, 244, 246, 248, and 250. If container 210 is empty or is filled with a colorless transparent liquid, the viewer may view the color exhibited by third discrete region 218 and the color exhibited by first discrete region 214 in combination by looking along sight lines 240, 242, and 244. In the above example, if the first discrete region 214 exhibits transparent blue and the third discrete region 218 exhibits transparent red, the viewer may view a violet color by looking along sight lines 240, 242, and 244. If the second discrete region 216 exhibits transparent yellow and the third discrete region 218 exhibits transparent red, the viewer may view an orange color by looking along sight lines 246, 248, and 250. Thus, a viewer may look through a discrete region of the sidewall 212 of container 210 and view different colors. It will be understood that the contents of the container may also have a transparent color which contributes to the appearance of the multi-colored container.

According to another embodiment of the invention, the container may include a light source, such as a white light emitting diode, which illuminates the contents of the container. In addition, the container may have one or more sides inscribed with an image, insignia, dot code and/or bar code which is illuminated by the light source. It will be understood that the light source may be integral with the container or may be associated with a remote device that directs a beam of the light source on the container.

Figure 16:
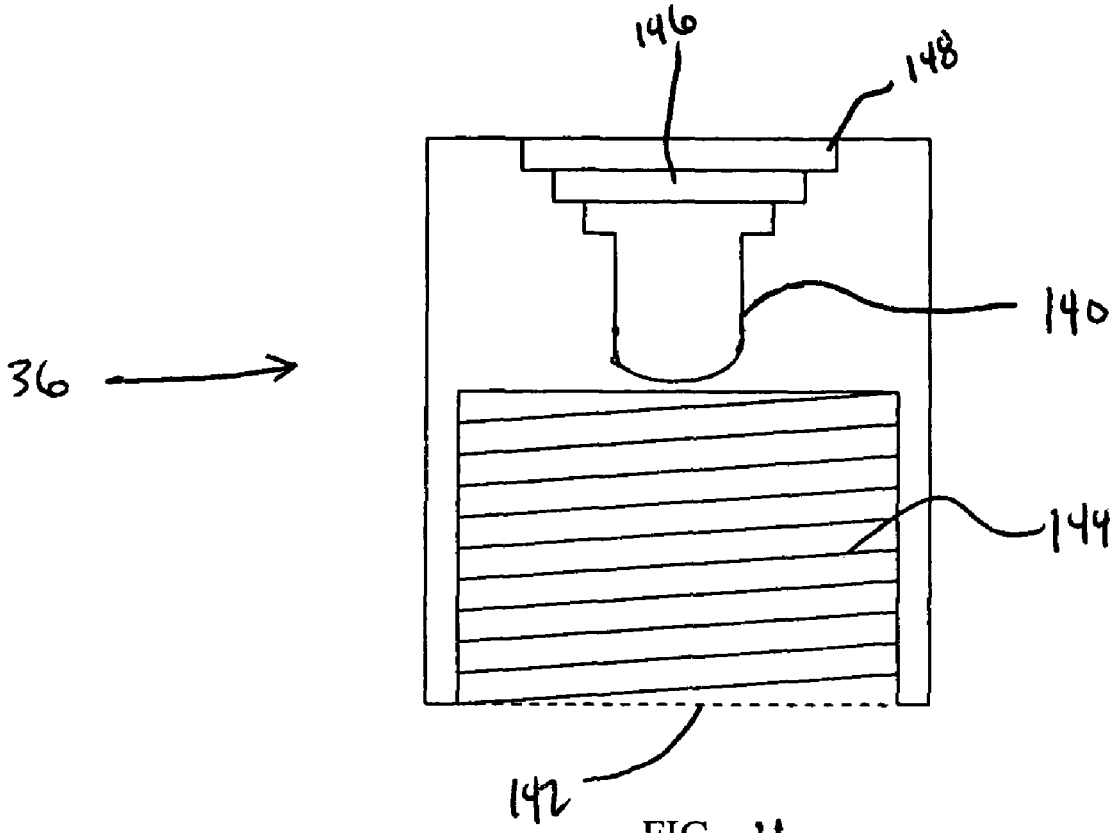
FIG. 16 is cross-section of a container cap having a battery-operated white light emitting diode according to the present invention.

With reference to FIG. 16, the light source may be a white light emitting diode 140 mounted in the container cap 36. As shown in FIG. 16, the bottom end of cap 36 includes a hollow recess 142 that has a threaded side wall 144 which sealing engages the threaded neck of the container. The top surface of the cap includes an opening which receives a white light emitting diode 140, which is powered by battery 146. The battery 146 is covered by a top disk 148.

Figure 17:
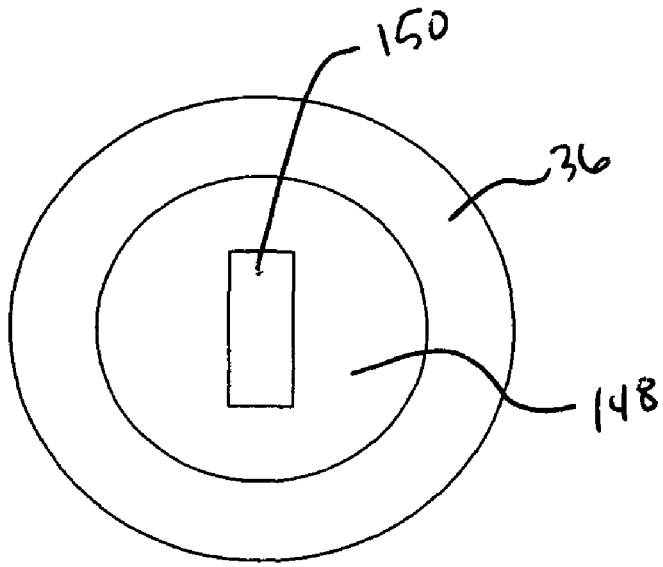
FIG. 17 is a top plan view of the container of FIG. 16.

With reference now to FIG. 17, top disk 148 may be selectively turned to an ON position or an OFF position. The top disk 148 includes two contacts which connect the battery 146 to the diode 140 such that when the top disk is turned to the ON position, the battery engages with the contacts and the diode illuminates the interior of the container with white light. Conversely, when top disk 148 is turned to the OFF position, the battery 146 is not engaged with the contacts and the diode 140 does not illuminate the interior of the container. Top disk 148 may include a slot 150 formed in its upper surface to effect turning of the top disk 148 between the ON position and the OFF position. Top disk 148 may be removably attached to container cap 36 to permit access to the battery 146 and diode 140 for servicing or replacement. Alternatively, the entire rotatable disk 148, battery 146 and white emitting diode 140 may be formed as an integral unit that may be removed and replaced as a unit.

It should be understood that the foregoing description of the invention is intended merely to be illustrative thereof, and that other embodiments, modifications and equivalents may be apparent to those skilled in the art without departing from the present invention.

That which is claimed is:

1. A container having a generally polygonal horizontal cross-section, comprising: (a) a plurality of generally flat transparent sidewalls; (b) a bottom wall; and (c) a top having an opening wherein a first transparent sidewall exhibits a first color, a second transparent sidewall exhibits a second color, and the first and second sidewalls combine to exhibit a third color.

2. The container according to claim 1, wherein the container has a generally triangular horizontal cross-section and comprises three sidewalls.

3. The container according to claim 2, wherein the container has a generally isosceles triangle horizontal cross-section.

4. The container according to claim 1, wherein the container has a generally square horizontal cross-section and comprises four sidewalls.

5. The container according to claim 1, wherein the container is formed from glass.

6. The container according to claim 1, wherein the container is formed from plastic.

7. The container according to claim 1, wherein the first and second colors are complimentary colors.

8. The container according to claim 7, wherein at least one of the sidewalls that exhibits complimentary colors is inscribed with a an uncolored image.

9. The container according to claim 8, wherein the uncolored image is a bar code.

* * * * *